US009823027B2

(12) United States Patent
Armsden et al.

(10) Patent No.: US 9,823,027 B2
(45) Date of Patent: Nov. 21, 2017

(54) COOLING MODULE AND METHOD OF ASSEMBLY

(71) Applicant: Hanon Systems, Daejeon (KR)

(72) Inventors: Richard Steven Armsden, Billericay (GB); Nigel Seeds, Chelmsford (GB); Thomas James Francis Kelham, Loughton (GB)

(73) Assignee: HANON SYSTEMS (KR)

( * ) Notice: Subject to any disclaimer, the term of this patent is extended or adjusted under 35 U.S.C. 154(b) by 48 days.

(21) Appl. No.: 15/008,512

(22) Filed: Jan. 28, 2016

(65) Prior Publication Data

US 2016/0216036 A1 Jul. 28, 2016

Related U.S. Application Data

(60) Provisional application No. 62/108,856, filed on Jan. 28, 2015.

(51) Int. Cl.
*F28F 9/26* (2006.01)
*F28F 9/013* (2006.01)
(Continued)

(52) U.S. Cl.
CPC ..... *F28F 9/013* (2013.01); *F28D 1/0461* (2013.01); *F28D 1/05366* (2013.01);
(Continued)

(58) Field of Classification Search
CPC ..... F28F 2275/08; F28F 9/007; F28F 9/02; F28F 9/013; F28F 9/002; F28F 21/062;
(Continued)

(56) References Cited

U.S. PATENT DOCUMENTS 5,269,367 A * 12/1993 Susa ..... B60R 11/00 165/140
5,704,418 A * 1/1998 Baader ..... F28F 9/002 165/121
(Continued)

FOREIGN PATENT DOCUMENTS

EP 1024045 A2 8/2000
GB 2118709 A 11/1983
(Continued)

*Primary Examiner* — Davis Hwu
(74) *Attorney, Agent, or Firm* — Shumaker, Loop & Kendrick, LLP; James D. Miller

(57) ABSTRACT

A cooling module includes a first heat exchanger, a second heat exchanger, and a plurality of coupling devices. The first heat exchanger includes a plurality of first brackets. A pair of the first brackets is disposed on each opposing end of the first heat exchanger. The second heat exchanger includes a plurality second brackets. A pair of the second brackets is disposed on each opposing end of the second heat exchanger. Each of the plurality of the coupling devices includes a first opening and a second opening formed therein. One of the coupling devices is positioned on each of the plurality of the first brackets, wherein each of the first brackets is received in one of the first openings of the one of the coupling devices. The second brackets of the second heat exchanger are inserted into respective ones of the second openings of the coupling devices.

20 Claims, 7 Drawing Sheets

(51) Int. Cl.

| | |
|---|---|
| ***F28F 21/06*** | (2006.01) |
| ***F28F 21/08*** | (2006.01) |
| ***F28D 1/04*** | (2006.01) |
| ***F28D 1/053*** | (2006.01) |

(52) U.S. Cl.
CPC ..... *F28F 21/062* (2013.01); *F28F 21/084* (2013.01); *F28F 2275/08* (2013.01); *F28F 2275/14* (2013.01)

(58) Field of Classification Search
CPC .... F28F 21/084; F28D 1/0233; F28D 1/0461; F28D 1/05366
USPC ..... 165/144, 67
See application file for complete search history.

(56) References Cited

U.S. PATENT DOCUMENTS

| | | | | | |
|---|---|---|---|---|---|
| 5,996,684 | A * | 12/1999 | Clifton | B60H 1/3229 | 165/121 |
| 2015/0047808 | A1* | 2/2015 | Takahashi | F28F 9/02 | 165/67 |

FOREIGN PATENT DOCUMENTS

| | | | |
|---|---|---|---|
| GB | 2262600 | A | 6/1993 |
| KR | 20080110102 | A | 12/2008 |

* cited by examiner

COOLING MODULE AND METHOD OF ASSEMBLY

CROSS REFERENCE TO RELATED APPLICATIONS

This application claims the benefit of U.S. Provisional Application Ser. No. 62/108,856, filed on Jan. 28, 2015. The entire disclosure of the above application is hereby incorporated herein by reference.

FIELD OF THE INVENTION

The invention relates to a cooling module, particularly to a cooling module having a plurality of heat exchangers coupled with a coupling device, and a method of assembly of the same.

BACKGROUND OF THE INVENTION

As is commonly known, a heat exchanger is employed to transfer heat between a fluid flowing through the heat exchanger and air. The heat exchanger typically contains a heat exchange core having a plurality of tubes or plates interposed with a plurality of fins. A pair of tanks is typically disposed on opposing ends of the core, and the tanks are in fluid communication with each other through the tubes or plates of the core.

The cores and tanks of a conventional heat exchanger are typically produced from materials having high heat transfer coefficients such as aluminum, brass, and copper. Particularly, the heat exchanger formed entirely of aluminum has become increasingly popular because of minimized weight and maximized performance compared to the heat exchanger formed from brass and copper. An aluminum heat exchanger is produced by welding or brazing aluminum tanks onto opposing ends of an aluminum core.

Although aluminum offers superior heat transfer performance, it does not come without drawbacks. A geometry of aluminum tanks is relatively limited by manufacturing processes. Tanks and other components of the aluminum heat exchanger are often formed by extrusion and stamping processes, and complex geometries cannot be feasibly incorporated. Additionally, aluminum is relatively rigid, and lacks flexibility when formed of thicknesses sufficient for desired strength.

In a modern vehicle, it is common to combine multiple heat exchangers in a cooling module. Due to the aforementioned limitations, assembly of the aluminum heat exchanger may present challenges. For example manufacturing inconsistencies may cause misalignment of mounting components of the heat exchanger with respective mounting points in the vehicle. Misalignment issues are compounded when multiple aluminum heat exchangers are combined. Misalignments are commonly accommodated by using conventional mounting hardware such as bolts and fasteners, to couple the heat exchangers to each other. However, due to the rigid nature of the aluminum heat exchanger, use of conventional mounting hardware may be difficult and timely. Additionally, the use of conventional fasteners increases manufacturing costs, as additional parts must be maintained in the supply chain and assembled with the vehicle.

It would be desirable to provide a means for assembling multiple aluminium heat exchangers in a cooling module without the use of conventional mounting hardware.

SUMMARY OF THE INVENTION

In accordance with the present invention, a means for assembling multiple aluminium heat exchangers in a cooling modules without the use of conventional mounting hardware has surprisingly been discovered.

A cooling module according to a first embodiment of the disclosure includes a first heat exchanger, a second heat exchanger, and a coupling device. The first heat exchanger includes a first bracket disposed on a first end of the first heat exchanger. The first bracket has a first leg. The second heat exchanger includes a second bracket disposed on a first end of the second heat exchanger. The second bracket has second leg. The coupling device has a first opening and a second opening formed therein. The first leg of the first bracket is received in the first opening and the second leg of the second bracket is received in the second opening.

In a second embodiment, a coupling drive for a cooling module includes a first opening and a second opening. The first opening is formed between a first outer wall and a second outer wall, and the second opening is formed between the second outer wall and a third wall. The first opening is configured to receive a first bracket of the cooling module in a first direction, and the second opening is configured to receive a second bracket of the cooling module in a second direction. The first direction is transverse to the second direction.

In a third embodiment, a method of assembling a cooling module includes providing a first heat exchanger, a second heat exchanger, and a plurality of coupling devices. The first heat exchanger includes a plurality of first brackets. A pair of the first brackets is disposed on each opposing end of the first heat exchanger. The second heat exchanger includes a plurality second brackets. A pair of the second brackets is disposed on each opposing end of the second heat exchanger. Each of the plurality of the coupling devices includes a first opening and a second opening formed therein. One of the coupling devices is positioned on each of the plurality of the first brackets, wherein each of the first brackets is received in one of the first openings of the one of the coupling devices. Each of the second brackets of the second heat exchanger is inserted into a respective one of the second openings of the coupling devices.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawing which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner.

Figure 1:
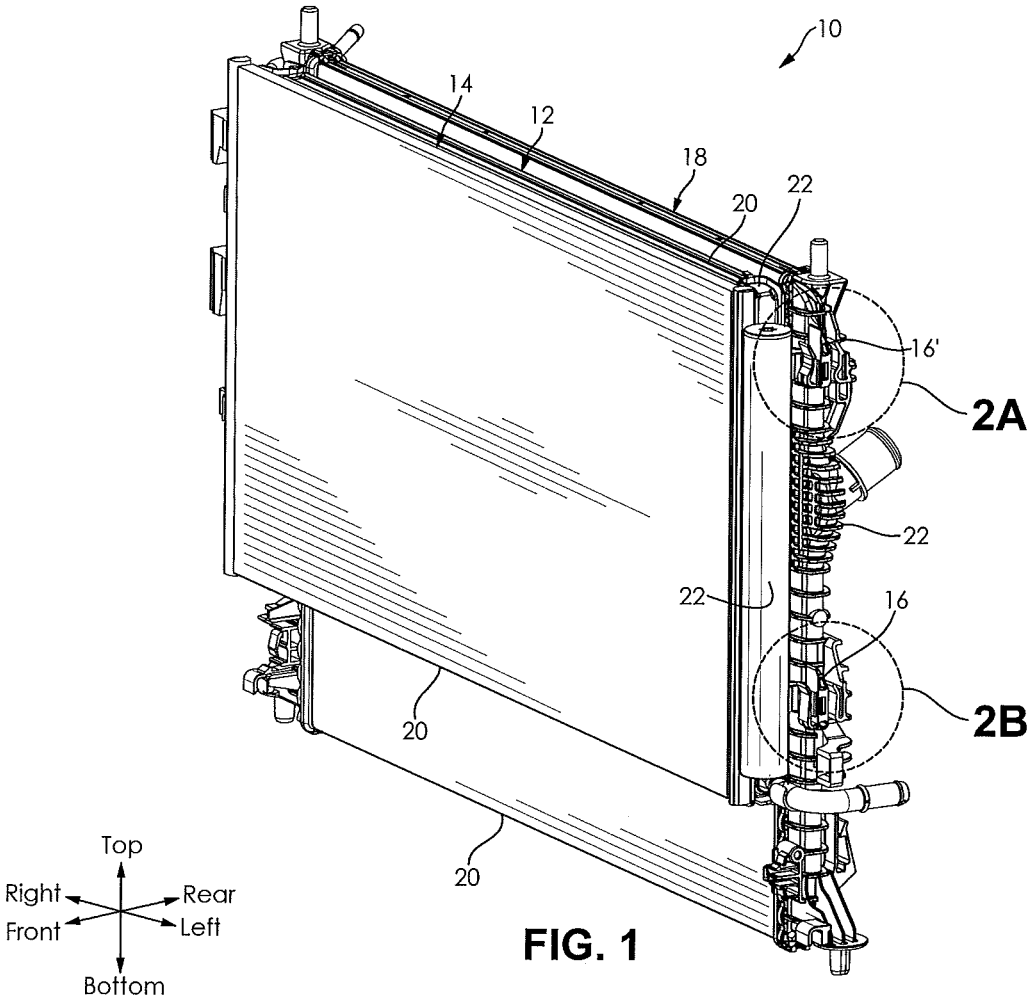
FIG. 1 is a front perspective view of a cooling module according to an embodiment of the disclosure.
Figure 2A:
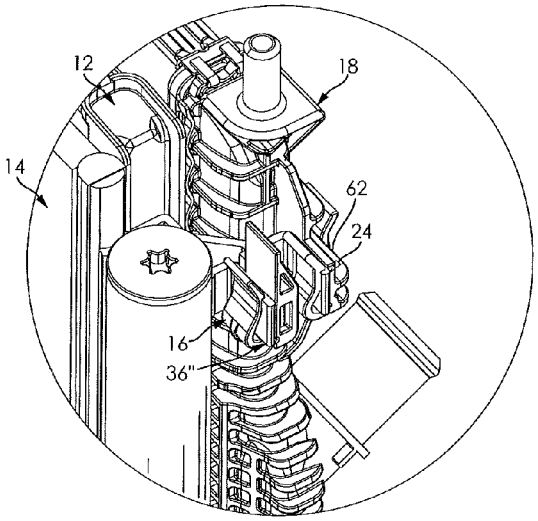
FIG. 2A is an enlarged fragmentary perspective view of the cooling module in circle 2A of FIG. 1.
Figure 2B:
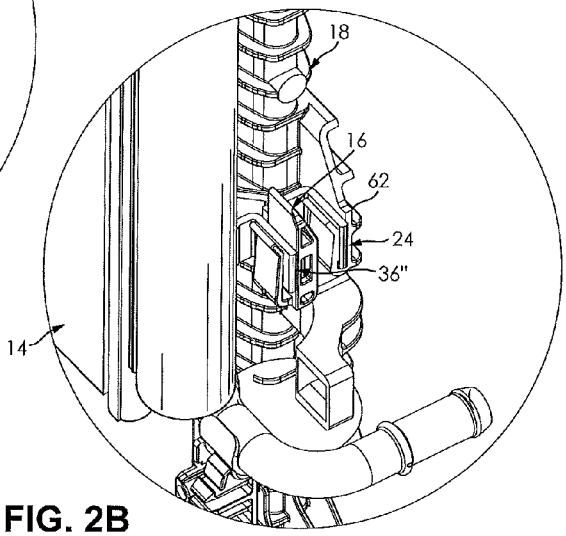
FIG. 2B is an enlarged fragmentary perspective view of the cooling module in circle 2B of FIG. 1.
Figure 3:
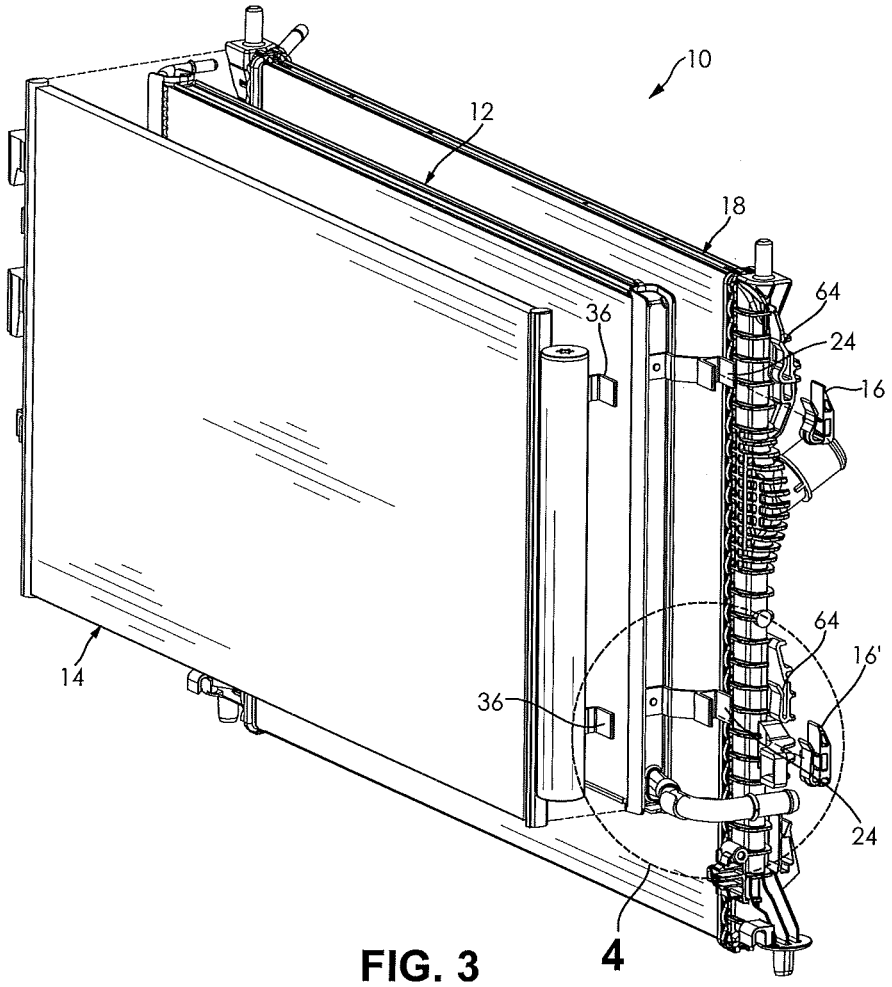
FIG. 3 is a partially exploded front perspective view of the cooling module of FIG. 1.
Figure 5:
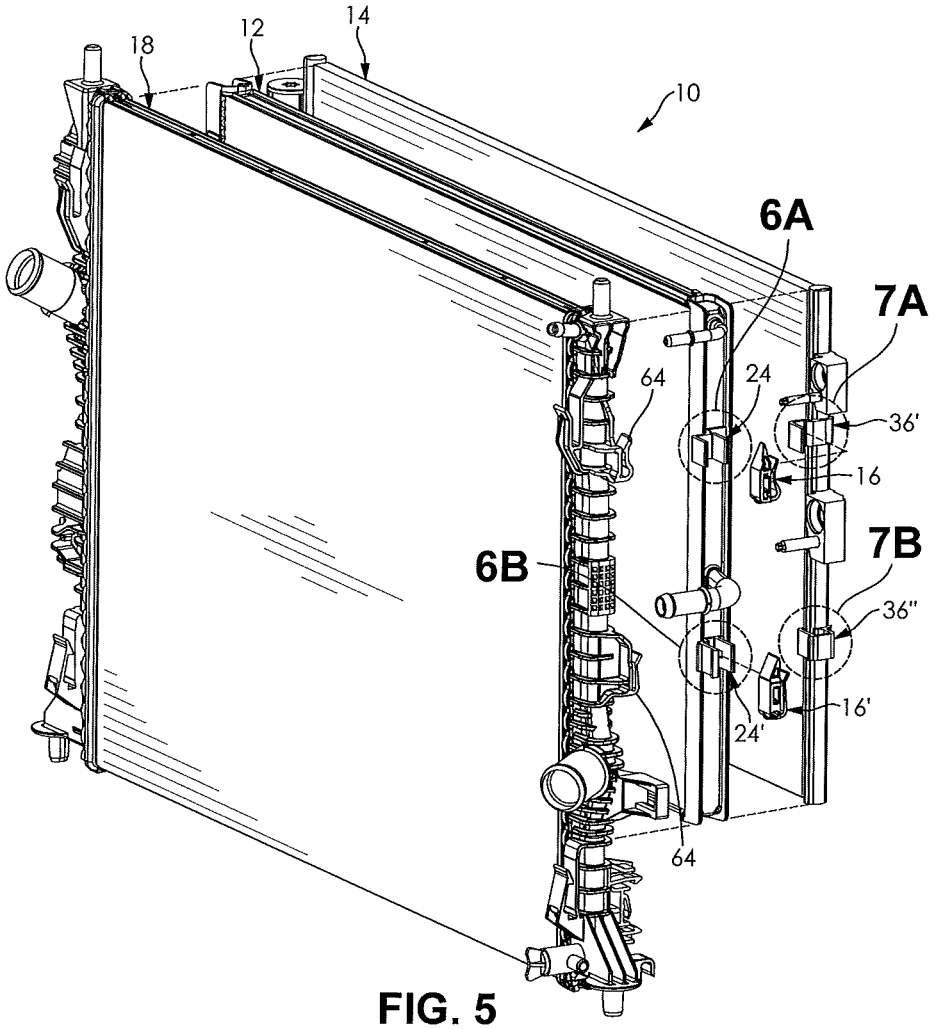
FIG. 5 is a partially exploded rear perspective view of the cooling module of FIG. 1.

A cooling module 10 according to the instant disclosure is shown generally in FIGS. 1, 3, and 5. The cooling module 10 includes a first heat exchanger 12 and a second heat exchanger 14 coupled together by plurality of coupling devices 16, 16'. The first heat exchanger 12 and the second heat exchanger 14 may further be coupled to a third heat exchanger 18. As described herein, each of the heat exchangers 12, 14, 18 is a conventional heat exchanger known in the art. Each of the heat exchangers 12, 14, 18 includes a core 20 formed of a plurality of alternatingly stacked tubes and fins, and a pair of tanks 22 disposed on opposing ends of the core 20. In one embodiment, the first heat exchanger 12 is a low temperature radiator (LTR), the second heat exchanger 14 is a condenser for a vehicle heating ventilation and air conditioning (HVAC) system, and the third heat exchanger 18 is an engine radiator. Other types and arrangements of the heat exchangers 12, 14, 18 may also be used.

In the illustrated embodiment, the first heat exchanger 12 and the second heat exchanger 14 are aluminum heat exchangers, wherein the core 20 and the tanks 22 of each of the heat exchangers 12, 14 are formed from aluminum. The third heat exchanger 18 may include the core 20 produced from a metal with the tanks 22 formed from a polymer disposed thereon. In alternate embodiments, each of the heat exchangers 12, 14, 18 may include the core 20 formed of other materials suitable for transferring thermal energy such as brass and copper, for example. Additionally, the tanks 22 of any one of the heat exchangers 12, 14, 18 may be formed of a polymeric material or a metal such as carbon steel or stainless steel, and may be joined to the core 20 by other means such as welding, brazing, crimping, or using fasteners, for example. Those of ordinary skill in the art will appreciate other methods and materials for producing the heat exchangers 12, 14, 18 according to the instant disclosure.

As shown in FIGS. 1 through 6B, the first heat exchanger 12 includes a plurality of first brackets 24, 24'. In the illustrated embodiment, the first heat exchanger 12 includes a pair of the first brackets 24, 24' on each end.

Each of the first brackets 24, 24' includes a base 26, 26', a first leg 28, 28', and a second leg 30, 30' formed parallel to the first leg 28, 28'. In a first embodiment of the first brackets 24, shown in FIG. 6A, the first leg 28 extends from the base 26, and the second leg 30 extends from the first leg 28. In a second embodiment of the first brackets 24', shown in FIG. 6B, the second leg 30' may extend directly from the base 26'. The second leg 30, 30' may also be aligned at an oblique angle to the first leg 28, 28'.

In the illustrated embodiment of the cooling module 10, the first brackets 24, 24' are formed of an extruded aluminum, wherein the base 26, 26' of each of the first brackets 24, 24' is configured to be directly coupled to the first heat exchanger 12 by brazing or welding. However, the first brackets 24, 24' may be formed of other materials, and may be coupled to the first heat exchanger 12 by a mechanical means, an adhesive means, a combination of a mechanical means and an adhesive means, or otherwise as desired.

A first retention feature 32, 32' is formed in the first leg 28, 28' of the first bracket 24, 24' and is configured to secure the coupling device 16, 16' to the first bracket 24, 24'. The first retention feature 32, 32' may be one of a recess or a protrusion configured to engage the coupling device 16, 16', as described further below. In the first embodiment of the first bracket 24 shown in FIG. 6A, the first retention feature 32 is a channel formed in a front-facing surface of the first leg 28 in respect of the directional arrows in FIG. 1. In the second embodiment of the first bracket 24', shown in FIG. 6B, the first retention feature 32' is an aperture formed through the first leg 28' of the first bracket 24'.

Each of the first leg 28, 28' and the second leg 30, 30' is a substantially planar body. As shown in FIG. 6B, the second leg 30' may include at least one protuberance 34 formed on a rear-facing surface thereof in respect of the directional arrows in FIG. 1, wherein the protuberance 34 is configured to engage the third heat exchanger 18 to restrict lateral movement of the first heat exchanger 12 with respect to the third heat exchanger 18. The second leg 30' may include a pair of the protuberances 34 spaced apart from each other and configured to receive a portion of the third heat exchanger 18 therebetween.

The plurality of the first brackets 24, 24' of the first heat exchanger 12 may be identically configured, or may include any combination of features of the first brackets 24, 24' described hereinabove. For example, a first one of the first brackets 24 may be formed without a protuberance 34 and a second one of the first brackets 24' may include at least one protuberance 34.

Figure 4:
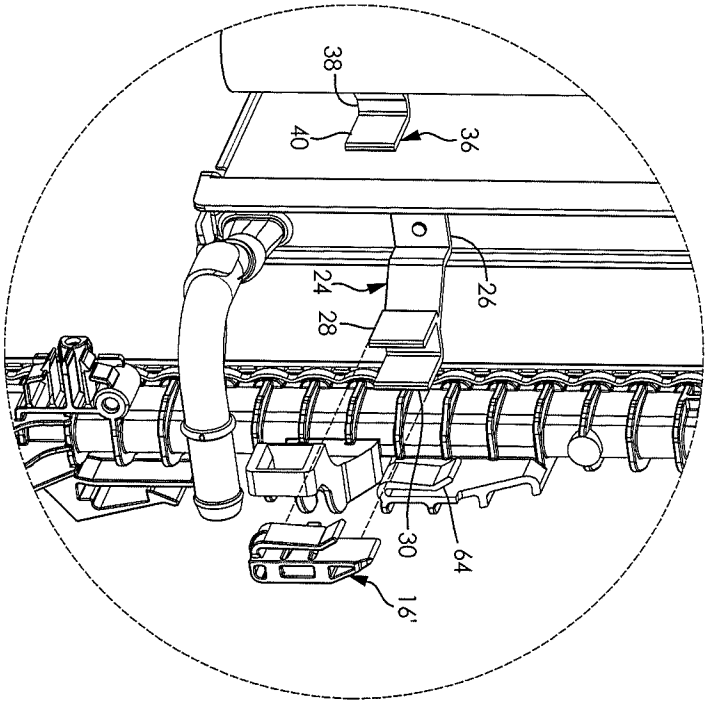
FIG. 4 is an enlarged fragmentary perspective view of the cooling module in circle 4 of FIG. 3.
Figure 7A:
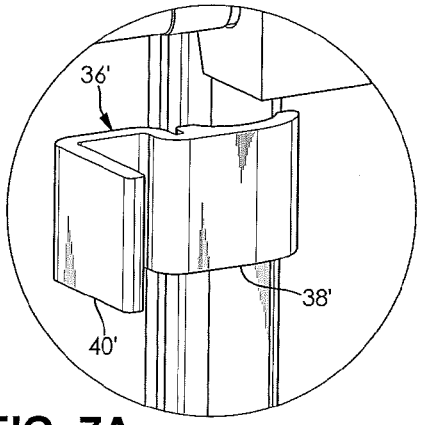
FIG. 7A is an enlarged fragmentary perspective view of the cooling module in circle 7A of FIG. 5 showing a second bracket.
Figure 7B:
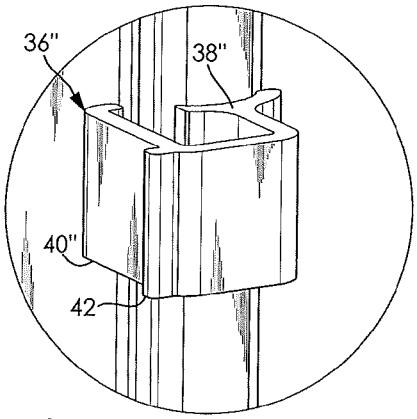
FIG. 7B is an enlarged fragmentary perspective view of the cooling module in circle 7B of FIG. 7 showing another embodiment of a second bracket.

As shown in FIGS. 4, 7A, and 7B, the second heat exchanger 14 includes a plurality of second brackets 36, 36', 36" disposed thereon. As shown, the second heat exchanger 14 includes a pair of the second brackets 36, 36', 36" on each of the ends.

Each of the second brackets 36, 36', 36" includes a base 38, 38', 38" and a leg 40, 40, 40" extending from the base 38, 38', 38". The base 38, 38', 38" is configured to couple to one of the ends of the second heat exchanger 14. The leg 40, 40', 40" of the second bracket 36, 36', 36" shown is a substantially planar body.

In the illustrated embodiment, the second brackets 36, 36', 36" are formed from an extruded aluminum, and the base 38, 38', 38" of each of the second brackets 36, 36', 36" is configured to be directly coupled to the tanks 22 of the second heat exchanger 14 by brazing or welding. However, the second brackets 36, 36', 36" may be formed from other materials, and may be coupled to the second heat exchanger 14 by a mechanical or an adhesive means, a combination of a mechanical means and an adhesive means, or otherwise as desired.

The leg 40, 40', 40" of each of the second brackets 36, 36', 36" illustrated is a substantially planar body. As shown in FIG. 7B, the leg 40" of the second bracket 36" may include at least one protuberance 42 formed on a rear-facing surface thereof, wherein the protuberance 42 is configured to engage the coupling device 16, 16', 16" to restrict lateral movement of the second heat exchanger 14 with respect to the coupling device 16, 16', 16". The leg 40" of the second bracket 36" may include a pair of the protuberances 42 spaced apart from each other and configured to receive a portion of the coupling device 16, 16', 16" therebetween.

The plurality of the second brackets 36, 36', 36" of the second heat exchanger 14 may be identically configured, or may include a combination of the embodiments of the second brackets 36, 36', 36" described hereinabove. For example, a first one of the second brackets 36, 36' may be formed without the protuberance 42, and a second one of the second brackets 36" may include at least one protuberance 42.

Figure 8A:
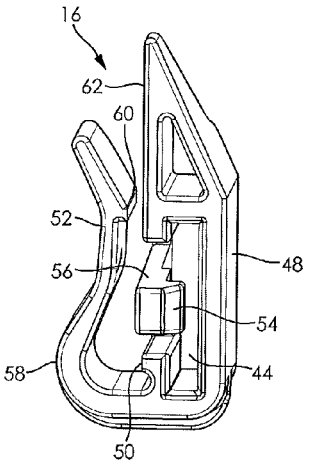
FIG. 8A is a perspective view of a coupling device according to an embodiment of the disclosure.
Figure 8B:
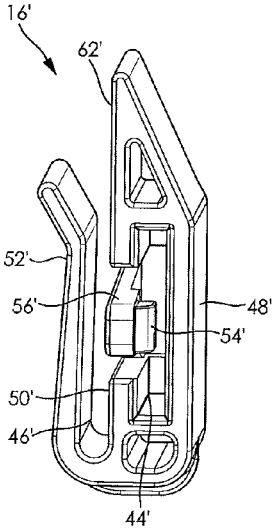
FIG. 8B is a perspective view of a coupling device according to another embodiment of the disclosure.
Figure 8C:
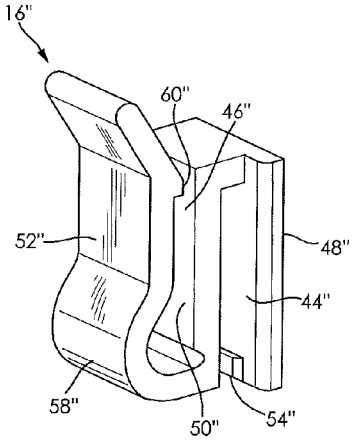
FIG. 8C is a perspective view of a coupling device according to another embodiment of the disclosure.

Each of the coupling devices 16, 16', 16" is formed of a resilient material such as a polymeric material or the like. As shown in FIGS. 8A, 8B, and 8C, each of the coupling devices 16, 16", includes a first opening 44, 44', 44" configured to receive a portion of the first bracket 24, 24' and a substantially parallel second opening 46, 46', 46" configured to receive a portion of the second bracket 36, 36', 36".

In a first embodiment of the coupling device 16 and second embodiment of the coupling device 16', the first opening 44, 44' is configured to receive the first bracket 24, 24' from a first direction, and the second opening 46, 46' is configured to receive the second bracket 36, 36', 36" from a second direction, wherein the first direction is transverse to the second direction. For example, as shown in FIGS. 8A and 8B, the first opening 44, 44' may be a sideways-opening aperture configured to laterally receive the first leg 28, 28' of the first bracket 24, 24' from a side of the coupling device 16, 16', and the second opening 46, 46' may be an upward-opening slot configured to vertically receive the leg 40 of the second bracket 36, 36' from a top of the coupling device 16, 16', wherein the first direction is perpendicular to the second direction.

In a third embodiment of the coupling device 16" shown in FIG. 8C, the first opening 44" is a downward-opening slot configured to receive the first leg 28 of the first bracket 24, 24' from a bottom of the coupling device 16" and the second opening 46" is configured to receive the leg 40, 40', 40" of the second bracket 36, 36', 36" from the top of the coupling device 16", wherein the first direction and the second direction are substantially aligned but opposite each other.

The first opening 44, 44', 44"' is partially defined by a first outer wall 48, 48', 48" of the coupling device 16, 16', 16" and an intermediate wall 50, 50', 50" of the coupling device 16, 16', 16", and the second opening 46, 46', 46" is partially defined by the intermediate wall 50, 50', 50" and a second outer wall 52, 52', 52" of the coupling device 16, 16', 16". In the first and third embodiments of the coupling device 16, 16", shown in FIGS. 8A and 8C, the first opening 44, 44" traverses an entire width of the coupling device 16, 16", wherein insertion of the first bracket 24, 24' through the first opening 44, 44' is unobstructed. Alternately, as shown in FIG. 8B, the first opening 44' may only partially traverse the width of the coupling device 16', wherein the first opening 44' is configured to obstruct the insertion of the first bracket 24, 24' through the first opening, thereby restricting lateral movement of the coupling device 16' with respect to the first bracket 24, 24'.

The coupling device 16, 16' may further include a second retention feature 54, 54' configured to cooperate with the first retention feature 32, 32' of the first bracket 24, 24' when the first bracket 24, 24' is received in the first opening 44, 44'. As introduced hereinabove, the first retention feature 32, 32' may be one of a recess and a protrusion. Accordingly, the second retention feature 54, 54' may be the other of a recess and a protrusion, wherein the first retention feature 32, 32' and the second retention feature 54, 54' are configured to cooperate and engage each other to secure the coupling device 16, 16' to the first bracket 24, 24'. In the embodiment of the coupling device 16, 16' shown in FIGS. 8A-B, the second retention feature 54, 54' is formed on a distal portion of a flexible tab 56, 56' extending from the intermediate wall 50, wherein the a portion flexible tab 56, 56' is configured to move laterally with respect to the first outer wall 48, 48'.

Figure 6A:
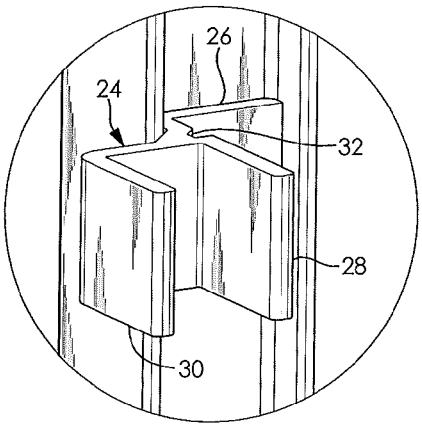
FIG. 6A is an enlarged fragmentary perspective view of the cooling module in circle 6A of FIG. 5 showing a first bracket.
Figure 6B:
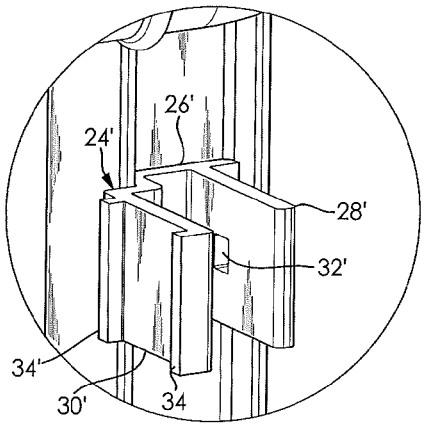
FIG. 6B is an enlarged fragmentary perspective view of the cooling module in circle 6B of FIG. 5 showing another embodiment of a first bracket.

In the first embodiment of the coupling device 16 shown in FIG. 8A, the second retention feature 54, 54' is a protrusion configured to be received in the channel of the embodiment of the first bracket 24 shown in FIG. 6A. In the second embodiment of the coupling device 16' shown in FIG. 8B, the second retention feature 54, 54' is a protrusion configured to be received in the aperture of the embodiment of the first bracket 24' shown in FIG. 6B. A leading edge of the second retention feature 54, 54' may be inclined to facilitate sliding of the first leg 28, 28' of the first bracket 24, 24' past the protrusion when the coupling device 16, 16' is installed on the first bracket 24, 24'.

In the third embodiment of the coupling device 16", the second retention feature 54" is disposed within the first opening 44" adjacent a distal portion of the first leg 48", wherein the second retention feature is configured to engage an edge of the first leg 28, 28' when the first leg 28, 28' is received within the first opening 44".

Referring to FIGS. 8A-C, the second outer wall 52, 52', 52'" of the coupling device 16, 16', 16" is configured to flex inward and outward with respect to the intermediate wall 50, 50', 50'". As shown in FIGS. 8A and 8C, the second outer wall 52, 52" may be joined to the coupling device 16 by an outwardly contoured shoulder 58, 58" to maximize flexibility of the second outer wall 52, 52". A distal portion of the second outer wall 52, 52', 52" may be tapered outwardly with respect to a surface of the intermediate wall 50, 50', 50" to facilitate reception of the leg 40 of the second bracket 36 in the second opening 46, 46', 46".

The second outer wall 52, 52', 52" may further include a third retention feature 60, 60" formed within the second opening 46, 46". In the illustrated embodiment, the third retention feature 60, 60" is a lip extending into the second opening 46, 46" configured to engage a trailing edge of the leg 40, 40', 40" of the second bracket 36, 36', 36" when the leg 40, 40', 40" is received in the second opening 46, 46". Alternatively, the third retention feature 60 may be a detent configured to receive a corresponding feature (not shown) of the second bracket 36, 36', 36".

The coupling device 16, 16' may further include a guide 62, 62' formed opposite the distal portion of the second outer wall 52, 52'. In the illustrated embodiment, the guide 62, 62' is an extension of the intermediate wall 50, 50', and extends beyond the distal portion of the second outer wall 52, 52'. The guide 62, 62', is configured to align the leg 40, 40', 40" with an entryway of the second opening 46, 46" during assembly of the cooling module 10.

The tanks 22 of the third heat exchanger 18 include a plurality of clips 64 integrally formed thereon. The clips 64 include an opening configured to receive the second leg 30, 30' of the first bracket 24, 24' of the first heat exchanger 12.

In the illustrated embodiment, the opening of the clips 64 is an upward-facing opening configured to vertically receive the first brackets 24, 24' of the first heat exchanger 12.

During assembly of the cooling module 10, the first heat exchanger 12 is provided adjacent a front side of the third heat exchanger 18, wherein the second legs 30, 30' of each of the first brackets 24, 24' is aligned vertically above the opening of a respective one of the clips 64. The first heat exchanger 12 is then lowered and the second legs 30, 30' of the first bracket 24, 24' are received in respective openings of the clips 64 of the third heat exchanger 18 to couple the first heat exchanger 12 to the third heat exchanger 18. When present, the protuberances 34' of the respective second legs 30' cooperate with the clips 64 to restrict relative lateral movement of the first heat exchanger 12 with respect to the third heat exchanger 18.

One of the coupling devices 16, 16' is then assembled to each of the first brackets 24, 24' wherein the first opening 46, 46' is aligned with a distal end of the first leg 28, 28'. The first leg 28, 28' of each one of the first brackets 24, 24' is inserted in the first opening 44, 44' of a respective one of the coupling devices 16, 16'. The distal end of the first leg 28, 28' engages the inclined leading edge of second retention feature 54, 54' prior to the distal end of the first leg 28, 28' extending into the first opening 44, 44'. The engagement of the inclined leading edge of the second retention feature 54, 54' with the first leg 28, 28' causes the flexible tab 56, 56' to flex in a lateral direction away from the first outer wall 48, 48'. The flexing of the flexible tab 56, 56' causes the second retention feature 54, 54' to be moved away from the first outer wall 48, 48' to an extent wherein the first leg 28, 28' may be received within the first opening 44, 44'. As the first leg 28, 28' continues to be inserted into the first opening 44, 44', the second retention feature 54, 54' will reach first retention feature 32, 32', thereby allowing the second retention feature 54, 54' to engage the first retention feature 32, 32' to form a snap-fit connection between the first leg 28, 28' and the coupling device 16, 16' via the first opening 44, 44'. Engagement of the second retention feature 54, 54' with the first retention feature 32, 32' restricts lateral movement of the coupling device 16, 16' with respect to the first heat exchanger 12. Each of the coupling devices 16, 16' is arranged wherein the upward-opening slot forming the second opening 46, 46' of each of the coupling devices 16, 16' is positioned forward of the first opening 44, 44' in respect of the direction arrows shown in FIG. 1.

Following insertion of the first leg 28, 28' of the first bracket 24, 24' into the first opening 44, 44' of the coupling device 16, 16', a the leg 40, 40', 40" of the second bracket 36, 36', 36" may be placed adjacent and aligned with the second opening 46, 46' formed in the coupling device 16, 16', 16". The second bracket 36, 36', 36" is then inserted into the second opening 46, 46' in a direction that is transverse to the direction the first leg 28, 28' is inserted into the first opening 44, 44'. The second bracket 36, 36', 36" may for example be inserted into the second opening 46, 46' in a direction perpendicular to the direction the first bracket 24, 24' is inserted into the first opening 44, 44'. During insertion into the second opening 46, 46', the second bracket 36, 36', 36" engages the tapered distal end of the second outer wall 52, 52'. As the second bracket 36, 36', 36" is inserted further into the second opening 46, 46' the engagement of the second outer wall 52, 52' with the second bracket 36, 36', 36" causes the second outer wall 52, 52' to flex in a lateral direction away from the intermediate wall 50, 50' until the second bracket 36, 36', 36" is received within the second opening 46, 46'. In the illustrated embodiment, the second brackets 36, 36', 36" are inserted by lowering the second heat exchanger 14 in front of the first heat exchanger 12, wherein the second brackets 36, 36', 36" of the second heat exchanger 14 are simultaneously received by the coupling devices 16, 16' assembled to the first heat exchanger 12.

When the third retention feature 60 is present on the second outer wall 52, and the second bracket 36, 36', 36" is received within the second opening 46, the second outer wall 52 is able to flex back to its original position. The third retention feature 60 then engages the leg 40, 40', 40", thereby restricting movement of the second bracket 36, 36', 36" in a direction opposite of the direction the second bracket 36, 36', 36" is inserted into the second opening 46 by means of the third retention feature 60 blocking passage of the second bracket 36, 36', 36" thereby.

The coupling device 16, 16' may be removed from the first leg 28, 28' of the first bracket 24, 24' by flexing the flexible tab 56, 56' in a lateral direction away from the first outer wall 48, 48' to disengage the second retention feature 54, 54' from the first retention feature 32, 32', thereby allowing the first leg 28, 28' to be removed from the first opening 44, 44' in a lateral direction. The coupling device 16, 16' may further be removed from the second bracket 36, 36', 36" by flexing the second outer wall 52 in a lateral direction away from the intermediate wall 50 to allow the second bracket 36, 36', 36" to be removed beyond the third retention feature 60 of the second outer wall 52.

The protuberances 42 of the legs 40" of the second bracket 36" cooperate with the intermediate wall 50, 50' to restrict relative lateral movement of the second heat exchanger 14 with respect to the coupling device 16, 16'. Accordingly, the clips 64, the protuberances 34 of the first brackets 24', the first retention feature 32, 32', the second retention feature 54, 54', the protuberances 42 of the second brackets 36, 36', and the intermediate wall 50, 50' of the coupling device 16, 16' all cooperate to restrict lateral movement of the first heat exchanger 12 and the second heat exchanger 14 with respect to the third heat exchanger 18.

The coupling device 16, 16' therefore advantageously allows for the first bracket 24, 24' and the second bracket 36, 36', 36" to be coupled to one another using a pair of snap-fit connections, thereby simplifying the process of coupling the first heat exchanger 12 to the second heat exchanger 14.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A cooling module, comprising:

a first heat exchanger including a first bracket disposed on a first end of the first heat exchanger, the first bracket having a first leg;

a second heat exchanger including a second bracket disposed on a first end of the second heat exchanger, the second bracket having a second leg; and a coupling device having a first opening and a second opening, the first opening configured to receive the first leg of the first bracket and the second opening configured to receive the second leg of the second bracket.

2. The cooling module of claim 1, further comprising a third heat exchanger including a clip disposed thereon, the first bracket having a third leg, the clip configured to receive the third leg of the first bracket.

3. The cooling module of claim 1, wherein the first opening is configured to receive the first leg of the bracket in a first direction, and the second opening is configured to receive the second leg of the second bracket in a second direction, wherein the first direction is transverse the second direction.

4. The method of claim 3, wherein the first direction is perpendicular to the second direction.

5. The method of claim 3, wherein the first direction is opposite the second direction.

6. The cooling module of claim 1, wherein the first bracket and the second bracket are formed from aluminum and the coupling device is formed from a resilient polymeric material.

7. The cooling module of claim 1, wherein the first bracket includes a first retention feature configured to engage a second retention feature of the coupling device, and the coupling device includes a third retention feature configured to engage the second leg of the second bracket.

8. The method of claim 7, wherein the first retaining feature is one of a protrusion and a recess, and the second retaining feature is the other of the protrusion and the recess, and the protrusion is received in the recess.

9. A coupling device for a cooling module comprising:

a first opening formed between a first wall and a second wall, the first wall facing the second wall; and a second opening formed between the second wall and a third wall, the second wall facing the third wall, wherein the first opening is configured to receive a first bracket of the cooling module in a first direction, and the second opening is configured to receive a second bracket of the cooling module in a second direction, wherein the first direction is transverse to the second direction.

10. The coupling device of claim 9, wherein the first direction is perpendicular to the second direction.

11. The coupling device of claim 9, wherein the first direction is opposite to the second direction.

12. The coupling device of claim 9, further comprising a retention feature configured to engage the first bracket of the cooling module.

13. The coupling device of claim 12, wherein the retention feature is disposed on a flexible tab extending from the second wall of the coupling device.

14. The coupling device of claim 9, further comprising a retention feature configured to engage the second bracket of the cooling module.

15. A method of assembling a cooling module, comprising:

providing a first heat exchanger including a plurality of first brackets, a pair of the plurality of first brackets disposed on each opposing end of the first heat exchanger;

providing a second heat exchanger including a plurality of second brackets, a pair of the plurality of second brackets disposed on each opposing end of the second heat exchanger; and providing a plurality of coupling devices, each of the plurality of coupling devices including a first opening and a second opening;

positioning one of the plurality of coupling devices on each of the plurality of first brackets, wherein each of the plurality of first brackets is received in the first opening of the one of the plurality of coupling devices; and inserting each of the plurality of second brackets of the second heat exchanger into a respective one of the second openings of the plurality of coupling devices.

16. The method of claim 15, wherein each of the plurality of second brackets of the second heat exchanger is inserted into the respective one of the second openings of the plurality of coupling devices.

17. The method of claim 15, wherein a first leg of one of the plurality of first brackets of the first heat exchanger is received in the first opening of one of the plurality of coupling devices, and a leg of one of the plurality of second brackets of the second heat exchanger is received in the second opening of one of the plurality of coupling devices.

18. The method of claim 17, wherein the second opening of the one of the plurality of coupling devices includes a retention feature formed therein, the retention feature configured to secure the leg of the one of the plurality of second brackets within the second opening of the one of the plurality of coupling devices when the one of the plurality of second brackets is inserted in the second opening.

19. The method of claim 18, wherein the retention feature is a lip configured to engage an edge of the one of the plurality of second brackets.

20. The method of claim 15, wherein one of the plurality of first brackets includes a first retention feature, and one of the plurality of coupling devices includes a second retention feature, the second retention feature configured to engage the first retention feature to secure the one of the plurality of coupling devices to the one of the plurality of first brackets.

* * * * *